United States Patent [19]

Eder

[11] Patent Number: 4,751,819

[45] Date of Patent: Jun. 21, 1988

[54] GAS COMPRESSOR DIRECTLY DRIVEN THROUGH HEAT INPUT

[76] Inventor: Franz X. Eder, Halmstr. 15a, 8000 München, Fed. Rep. of Germany

[21] Appl. No.: 882,931

[22] PCT Filed: Oct. 19, 1984

[86] PCT No.: PCT/DE84/00216

§ 371 Date: Jun. 18, 1986

§ 102(e) Date: Jun. 18, 1986

[87] PCT Pub. No.: WO86/02408

PCT Pub. Date: Apr. 24, 1986

[51] Int. Cl.[4] ..... F02G 1/04

[52] U.S. Cl. ..... 60/517

[58] Field of Search ..... 60/517–526; 62/6

[56] References Cited

U.S. PATENT DOCUMENTS

| | | | |
|---|---|---|---|
| 3,822,388 | 7/1974 | Martini et al. | 60/517 X |
| 4,455,825 | 6/1984 | Pinto | 60/525 |

FOREIGN PATENT DOCUMENTS

| | | | |
|---|---|---|---|
| 1961457 | 6/1971 | Fed. Rep. of Germany . | |
| 2855167 | 7/1980 | Fed. Rep. of Germany | 60/517 |
| 3229108 | 2/1984 | Fed. Rep. of Germany | 60/517 |
| 3246633 | 6/1984 | Fed. Rep. of Germany . | |
| 2104155 | 3/1983 | United Kingdom . | |

*Primary Examiner*—Allen M. Ostrager

*Attorney, Agent, or Firm*—Karl F. Ross; Herbert Dubno

[57] ABSTRACT

The compressor compresses a high pressure fluid such as gas or steam in a working chamber provided with a thermo-regenerator connected in parallel. Said fluid is alternatingly brought to a high temperature in the warm portion of the chamber by means of a heat supply and is taken down to a reduced temperature in the cold portion of the chamber by means of a refrigerator. The cold portion communicates with a fluid separator comprised of two chambers which are sealingly separated by means of a piston or an elastic membrane. The chamber of the fluid separator connected with the cold portion of the working chamber forms together with the latter a primary circuit of the compressor which uses as working fluid helium, hydrogen or an overheated steam of a condensable fluid. The second chamber is connected with two pressurized containers through two return valves with opposite passage and wherein the working fluid (liquid, gas-oil mixture) is stored at two different pressures. Said pressure differential generated by those periodic pressure changes in the primary circuit is transformed into mechanical work in an expansion motor of the secondary circuit. The pressures of the working fluid of the secondary circuit may be adapted substantially as desired to the optimum pressures of the motor by means of a three chamber separator with differential piston. The displacement piston enabling to obtain a periodic circulation in the regenerator is driven by the expansion motor and a crank-shaft.

15 Claims, 2 Drawing Sheets

GAS COMPRESSOR DIRECTLY DRIVEN THROUGH HEAT INPUT

CROSS-REFERENCE TO RELATED APPLICATIONS

This application is a National Phase application corresponding to PCT/DE 84/00216 filed Oct. 19, 1984.

FIELD OF THE INVENTION

The present invention relates to a thermomechanical converter of the type in which a gas forms the compressible fluid on a gas compressor side of the converter whereas another fluid medium containing a liquid forms a drive for an expansion motor.

BACKGROUND OF THE INVENTION

In a gas compressor, the energy supply is a result of an external combustion of gaseous, liquid or solid fuels and is converted into an adequate compression work.

SUMMARY OF THE INVENTION

According to the invention, a crank chamber receiving an electric motor-generator unit is connected to a movable-wall separator by a first check valve while a tank is connected to this separator by an oppositely directed second check valve to define a secondary fluid circuit for the liquid-containing medium which drives the expansion motor while the primary gas circuit includes a piston which is driven by a crank from this motor-generator unit and has a combustion chamber and cooler connected in parallel to the cylinder of the piston. The gaseous or vaporized working fluid is separated as effectively as possible from the driving fluid in two pressure tanks with different pressures and this pressure potential is to be used for the production of mechanical work or for the operation of a heat pump, respectively a refrigerating machine. In contrast to the known Stirling-motor the gas converter consists of the thermomechanical converter and a separate expansion motor, wherein the pressure difference produced by the converter is turned into mechanical work. Herein, high-pressure gas, preferably helium or hydrogen, is used as working medium for the pressure converter and the motor or the refrigerating machine connected to the pressure tank. In practice, this entails the disadvantage that, when working with high pressures, which is desirable in view of the reduced specific weight, a reliable sealing of the working meduim in the motor or the refrigerating machine becomes impossible. Furthermore, no usual expansion machine is known, which would allow for a dry gas operation.

The present invention avoids both disadvantages, due to the fact that between the thermomechanical converter and the expansion motor, respectively the refrigerating machine a separator is inserted, whereby various and differing working media can be used for the production of pressure in the converter and for the expansion device. Preferably, helium gas with high pressure is used in the converter and a gas-oil mixture in the expansion circuit, the latter allowing for the use of a lubricated and pressure-proof expansion machine.

BRIEF DESCRIPTION OF THE DRAWING

The invention is explained in greater detail with the aid of the embodiments represented in the drawing. In the drawing.

SPECIFIC DESCRIPTION

Figure 1:
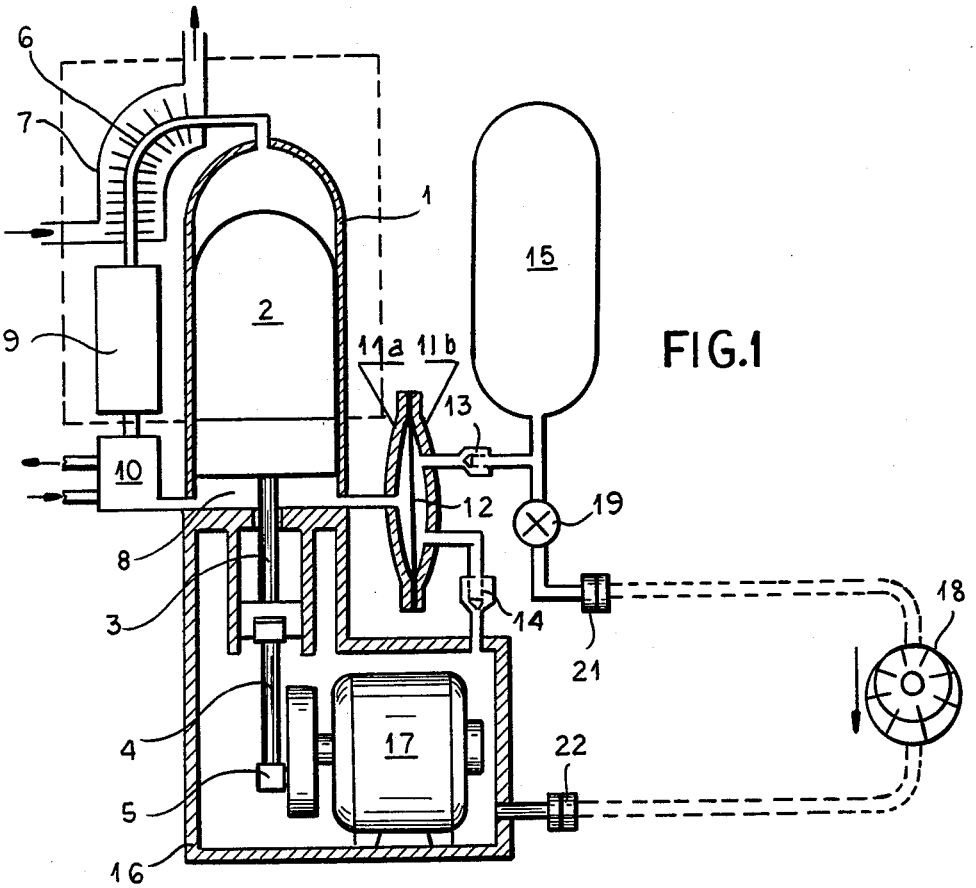
FIG. 1 is a schematic view of the gas compressor.

The gas converter comprises the working cylinder 1, wherein the recuperator piston 2 which is not heat conductive, fastened to the piston rod 3 passing through the cylinder bottom in pressure-sealed manner, is moved approximately sinusoidally between the upper and lower dead center by a crankshaft 5, over a cross-head guide and the piston rod 4. The heat energy necessary for the operation is supplied to the working cylinder 1 over the ribbed heat exchanger 6 inside the combustion chamber 7. The cylinder head and the lower cylinder area 8 are connected through the thermal regenerator 9, the cooler 10 and the mentioned ribbed heat exchanger 6, so that the recuperator piston 2 is solely under the load of the pressure difference resulted from the flow losses in the heat exchangers 6, 10 and the regenerator 9. The thermal insulation of the parts at high temperatures (400° to 800° C.) is only suggested in FIG. 1, but in fact it bears a part of the responsibility for the degree of efficiency reached in the transfer from heat- to pressure energy.

The lower working space 8 of the cylinder 1 is connected to the media separator, shown in FIG. 1 as a flat, divided pressure tank, consisting of two spherical caps **11*a*, 11*b*, which are separated in a gas-proof manner by the elastic membrane 12. The spherical cap 11*b* is connected with the pressure tank 15, respectively with the pressure-proof crank chamber 16 where the electromotor 17 driving the recuperator piston is located, via the return valves 13, 14 with opposite flow-passage directions. Between the high-pressure tank 15 and the crank chamber 16 functioning as a low-pressure tank, the expansion motor 18, whose mass flow is to be adjusted through the control valve 19**, is inserted.

Since the amounts of gas contained in the working cylinder 1 and in the partial volume **11*b* of the media separator, connected thereto, is constant, the gas pressure established in these areas will vary periodically, when the recuperator piston 2** is pushed back and forth between the two dead center positions.

Figure 2:
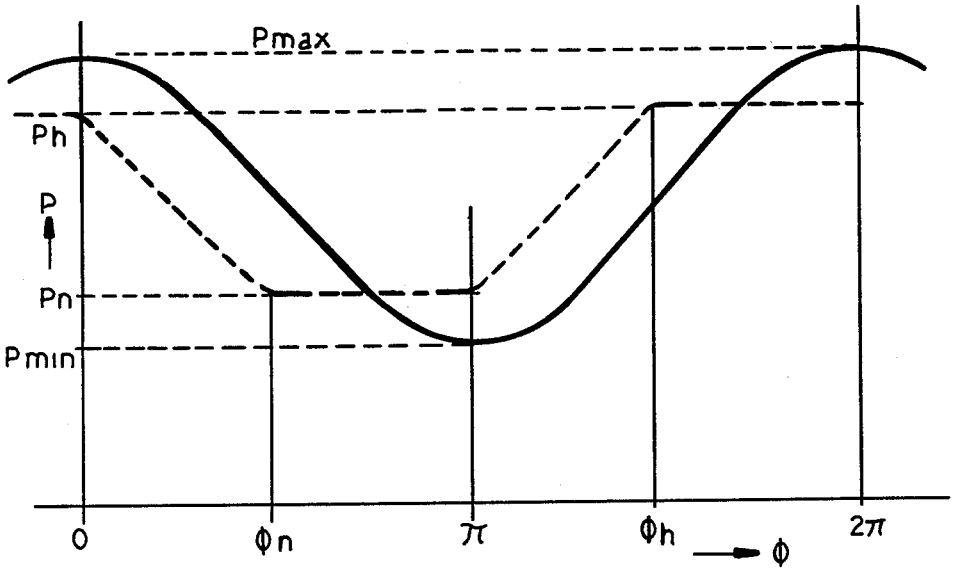
FIG. 2 is a diagrammatic representation of the pressure distribution of the working gas.

In FIG. 2 the pressure distribution in the working gas is shown, for the case when in the pressure tank 15 the pressure is higher than the one corresponding to the peak value in the working cylinder and the valve 19 is closed. The component parts 15, 16, and 18 connected to the chamber volume **11*b* of the fluid separator are filled with a gas-oil mixture. Besides helium and hydrogen, nitrogen and carbon dioxide are also suited as pressure gases, since their kinematic coefficient of viscosity is considerably higher and their adiabatic exponent lower than in the case of helium. The latter causes a reduced temperature decrease of the working medium during the expansion in the expansion motor 18**.

When the recuperator piston 2 is at the lower dead center, and, at this time the main amount of the working gas is in the upper cylinder portion, the gas pressure reaches its peak value and the volume of chamber **11*b* is compressed to the point where the gas pressure in the cylinder 1 is equivalent to the pressure $P_h$ in the tank 15, the return valve 14 remaining closed during this stage. During the upward movement of the recuperator piston 2, the gas pressure decreases and when the value $P_n$ equivalent to the pressure in the crank chamber 16 is reached, the valve is opened and the gas-oil mixture is aspired into the chamber 11***b;* in the extreme position, the membrane 12 is pressed against the inner wall of 11*a*.

With the valve 19 open, the gas-oil mixture with a pressure of $P_n$ is supplied to the expansion motor 18 and leaves it with a pressure of $P_n$. If the carried through volume flow is marked with V ($m^3/s$), the mechanical output produced in the expander amounts to $$P=(p_h-p_n)\dot{V}=\Delta p.\dot{V},$$

when the expander converts the pressure drop $\Delta p=p_h-p_n$.

In the case of a large throughput volume, the pressure drop in the converter will decrease, as results from the pressure distribution shown in dotted lines in FIG. 2, as plotted over the crank angle $\phi$. At the crank angle $\phi_h$, the valve 13 opens and the volume of chamber 11*b* of the fluid separator is pumped into the high-pressure tank 15, during the phase $\phi_h<\phi<2\pi$. During the upward travel of the recuperator piston 2, the gas pressure drops and reaches at the phase angle $\phi_n$ the pressure $p_n$ existing in the crank chamber 16. During $\phi_n<\phi<\pi$ the valve 14 stays open and the gas-oil mixture is aspired into the chamber 11*b*. With an increasing flow volume $\dot{V}$, which means with an increasing rotational speed n of the expander 18, the pressure differential ($p_h-p_n$) decreases, since the opening angles $\phi_n$, respectively $\phi_h$ shift according to smaller crank angles.

Figure 3:
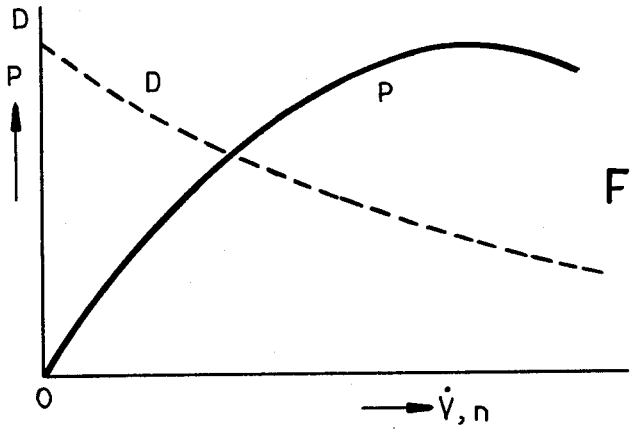
FIG. 3 is a diagrammatic representation of the throughput by volume of the thermomechanical converter.

From the mentioned interconnection, it results between $\Delta p$ and $\dot{V}$: for $\dot{V}=0$, which means that when the expansion motor is in its rest position, $\Delta p$ and thereby the produced torque will reach its peak value. When the rotation speed proportional to $\dot{V}$ increases, $\Delta p$ decreases, but the product $\Delta p.\dot{V}=P$ (power) reaches a peak value, which decreases again at high rotational speeds. Torque D and power P are plotted in FIG. 3 over flow volume $\dot{V}$ of the thermomechanical converter, respectively the rotation rate of the expander 18. The output characteristic of the machine consisting of the converter and the expansion motor corresponds to the one of an electromotor wound in series; when used for driving a vehicle, the coupling devices and a gear shift become therefore superfluous.

In the primary circuit, namely in the working cylinder 1 with heat exchangers 7, 9 and regenerator 8 connected therewith, the overheated vapor of a condensable substance, for instance propylene, fluorinated hydrocarbons can be used instead of helium- or hydrogen gas. The advantage of these substances, which strongly deviate from the ideal gas behavior when in the saturated vapor stage, for the primary circuit consists in the fact that for the same pressure relationship $p_h/p_n$ a lower temperature $T_2$ for the heat converter 6 (FIG. 1) can be applied and the losses in the cylinder 1 due to heat conduction and--radiation can be reduced.

In the secondary circuit of the fluid separator, which comprises, besides the pressure buffers, the expansion motor or a heat-producing machine, any working medium can be used. A mixture of nitrogen or carbon dioxide and mineral oil used as such offers the advantage that in the converter and the separator a relatively high work frequency can be applied and that for the secondary circuit the required lubrication and sealing of the expansion motor is insured. At the same time, when a polyatomic working medium is used in the secondary circuit, the temperature increase generated in the separator during the compression stage and the temperature decrease generated during the work output expansion stage in the motor are reduced due to the lower adiabatic exponent. The temperature decrease can be used to reduce the heat output to be directed towards the cooler 10, with the aid of an additional heat exchanger.

In the secondary circuit, instead of the crank chamber 16, a second pressure tank is connected to the return valve 14, whereto the expanded working medium from the expander 18 with the pressure $p_n$ is directed. Since the traditional expansion motors act like a pump when the direction of rotation is reversed, this characteristic, together with the mentioned pressure tanks, can be used to store the braking energy generated during braking of a vehicle driven by such an expansion motor. According to the invention, for this purpose, the gas conduits leading to the expander are interchanged with the aid of a special reversing valve.

Figure 4:
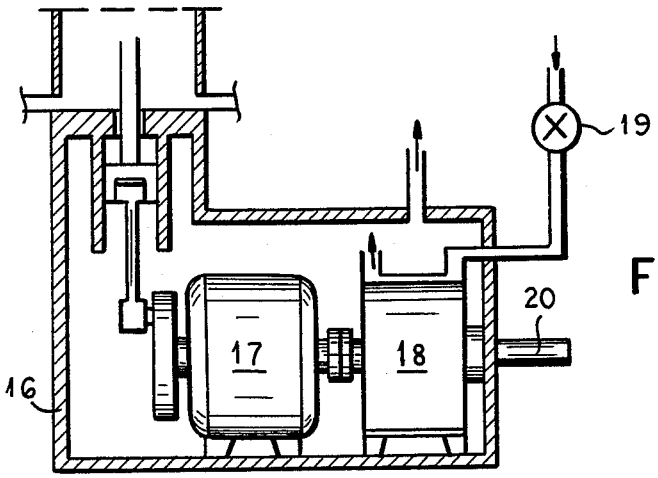
FIG. 4 is a partial view of a modified embodiment.

In a further constructive embodiment, which is shown in FIG. 4 in a simplified representation, the expansion motor 18 is also in the crank chamber 16. Its driven shaft 20 sealingly exits the crank chamber. The expansion motor 18 is coupled to the electric motor-generator 17 and after starting, not only drives the crank shaft 5, respectively the recuperator piston 2, but also can produce electric energy, alternately and controlably, which energy can be stored.

The expansion motor 18 does not have to be fixed to the location of the thermomechanical converter, but can be connected to the control valve 19, respectively the crank chamber 16, by means of flexible high-pressure hoses over the releasable couplings 21, 22. Furthermore, it is also possible to operate in parallel several expanders of this kind, whose rotation speed adjusts itself corresponding to the effective torque. Various possibilities of use arise in fields like propulsion of motor vehicles, movable and fixed lifting devices, mining equipment, etc.

The output and the dimensions of this novel heat engine can be derived from theoretical considerations and practical results: with a piston displacement of 1 $dm^3$, a heating temperature of $T_2=500°$ C., a peak pressure of $p_h=100$ bar, with a rotational speed of 1500 l/min, the theoretical mechanical output will equal approximately 25 kW; practically, this value is reached only in proportion of approximately 65%, through the efficiency degree of the converter and the expansion motor.

Higher outputs can be reached by building machines with several cylinders. The mutual alignment of the cylinders and the phase relationships of the recuperator piston are suitably chosen so that a/ the free forces of inertia compensate themselves, b/ the lower working spaces 8 of the cylinders with recuperator pistons working in the same phase are connected to the gas side 11*a* of a common fluid separator, c/ the high-temperature heat exchangers 6 of all working cylinders are mounted in a common combustion chamber.

Figure 5:
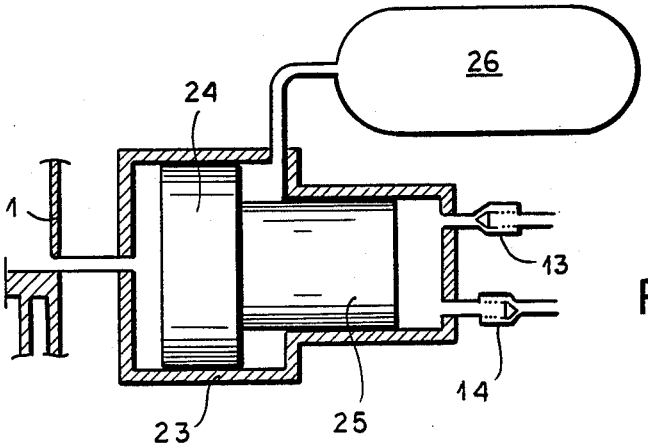
FIG. 5 is a partial view of a further embodiment.

FIG. 5 shows a fluid separator of special construction, advantageously replacing the one shown in FIG. 1 when the average working pressures in the primary and secondary circuits are to be different. In this embodiment, the differential piston 24, 25 is freely displaceable between the end bearings, in the pressure-sealed housing 23 with the return valves 13, 14. The volume defined by the rear side of the piston 24 and the housing 23 is filled for instance with the fluid of the secondary circuit and connected with the pressure tank 26, where the constant, adjustable compensation pressure $p_c$ exists. The extreme pressures $p'_h$ and $p'_n$ in the secondary circuit are translated into the ones of the primary circuit with respect to the corresponding piston cross sections. By selecting the proper compensation pressure $p_c$, the pressures indicated in FIG. 2 can be pushed downward and the minimum pressure $p_{min}$ can be compensated to approximately zero.

In comparison to the conventional heat engine, the following advantages can be pointed out:

1/ The described heat engine is driven through external heat energy supply, whereby liquid, gaseous or solid fuels can be used as primary energy sources. The working temperatures, which are fairly low during operation, maximum 800° C., result, in comparison to the traditional Otto- or Diesel engine, in only one tenth of their emission of noxious substances such as nitric oxides and carbon monoxide.

2/ The process taking place in the described heat engine is carried out at a small pressure ratio of 1:2, whereby the few movable parts, such as recuperator piston, have to be sealed only against reduced dynamic pressure differences which results in a long working life and operational safety.

3/ While in the primary circuit, preferably inert helium under high pressure is used, in the coupled secondary circuit, gas-oil mixtures are used as working medium, fulfilling, the additional function of sealing and lubrication.

4/ When applied to motor vehicle propulsion, single-wheel driving can be achieved in the most simple manner, since the expansion motors are connected to common pressure tanks by flexible pressure hoses. By reversing the input- and output ducts of the individual motors with the aid of conventional reversing valves, the braking energy can be stored as pressure energy in the pressure tanks.

What is claimed:

1. A thermomechanical converter driven through heat input comprising:

a primary circuit including:

a working cylinder;

an axial displacement reciprocating piston in said cylinder defining first and second zones on opposite sides of said piston, respectively containing a hot portion of a working gas and a cool portion of said working gas;

said cylinder being provided with an inlet opening into said first zone and an outlet communicating with said second zone; and a cooler connected to said outlet and a combustion chamber connected to said inlet, said cooler and said combustion chamber being connected to each other and in parallel to said cylinder;

a separator having two compartments separated by a movable wall and means connecting one of said compartments to said second zone; and a secondary circuit separated from said primary circuit by said movable wall of said separator and comprising:

a tank receiving a working medium different from said gas and including a liquid, a crank chamber, substantially filled with said working medium, an electric motor-generator, mounted in said crank chamber, a crankshaft in said crank chamber driven by said motor-generator, connected to said piston, a first checkvalve connecting said tank to the other of said compartments of said separator, and a second checkvalve having a flow passage direction opposite that of said first checkvalve and connecting said crank chamber to said other compartment of said separator; and an expansion motor connected between said tank and said crank chamber and driven by said medium as said medium is displaced from said tank to said crank chamber by movement of said wall.

2. The thermomechanical converter defined in claim 1 wherein said work medium is a mixture of nitrogen or carbon dioxide and mineral oil.

3. The thermomechanical converter defined in claim 1 wherein said combustion chamber has a ribbed heat exchanger wall.

4. The thermomechanical converter defined in claim 1 wherein said separator comprises a differential piston defining three interdependent chambers correspondingly connected to said second zone of said cylinder, to another tank containing said working gas and said tank and to said crank chamber by means of said checkvalves.

5. The thermomechanical converter defined in claim 1 wherein said separator has concave caps.

6. The thermomechanical converter defined in claim 1 wherein said movable wall is made of metal or rubber elastic material.

7. The thermomechanical converter defined in claim 1 wherein said expansion motor is inside said crank chamber.

8. The thermomechanical converter defined in claim 1, further comprising at least two expansion motors connected in parallel to each other.

9. A thermomechanical converter driven through heat input comprising:

a primary circuit including:

a working cylinder;

an axial displacement reciprocating piston in said cylinder defining first and second zones on opposite sides of said piston, respectively containing a hot portion of a working gas and a cool portion of said working gas;

said cylinder being provided with an inlet opening into said first zone and an outlet communicating with said second zone; and a cooler connected to said outlet and a combustion chamber connected to said inlet, said cooler and said combustion chamber being connected to each other and in parallel to said cylinder;

a separator having two compartments separated by a movable wall and means connecting one of said compartments to said second zone; and a secondary circuit separated from said primary circuit by said movable wall of said separator and comprising:

a tank receiving a working medium different from said gas, a crank chamber, substantially filled with said working medium, a drive motor mounted in said crank chamber, a crankshaft in said crank chamber driven by said motor and connected to said piston, a first check valve connecting said tank to the other of said compartments of said separator, and a second checkvalve having a flow passage direction opposite that of said first checkvalve and connecting said crank chamber to said other compartment of said separator; and an expansion motor connected between said tank and said crank chamber and driven by said medium as said medium is displaced from said tank to said crank chamber by movement of said wall.

10. The thermomechanical converter defined in claim 9 wherein said combustion chamber has a ribbed heat exchanger wall.

11. The thermomechanical converter defined in claim 10 wherein said separator comprises a differential piston defining three interdependent chambers correspondingly connected to said second zone of said cylinder, to another tank containing said working gas and said tank and to said crank chamber by means of said check valves.

12. The thermomechanical converter defined in claim 9 wherein said movable wall is made of metal material.

13. The thermomechanical converter defined in claim 9 wherein said movable wall is made of rubber-elastic material.

14. The thermomechanical converter defined in claim 9 wherein said expansion motor is inside said crank chamber.

15. A heat-driven gas compressor, comprising:

a single working cylinder having a hot end and a cold end and a piston reciprocatable in said cylinder and separating said ends from one another;

a thermal circuit connected in parallel with said working cylinder and including a heater for introducing a hot fluid into said hot end, a cooler connected to said cold end, and means including a regenerator between said cooler and said heater for connecting said cooler and said heater in series for flow of said fluid through said circuit;

a fluid separator comprising a housing, means in said housing including a movable gastight wall dividing the interior of said housing into a first chamber connected to said cold end of said cylinder by a single passage, and a second chamber receiving a working medium different from said fluid;

a pair of oppositely traversable checkvalves connected to said second chamber and constituting the sole means of ingress and egress of said working medium therefore;

a respective pressure vessel directly connected to each of said checkvalves containing said flowable working medium; and a machine drivable by said working medium connected between said pressure vessels and propelled by a pressure difference generated across said pressure vessels by displacement of said wall by said fluid.

* * * * *